US007436365B1

(12) United States Patent
Tan et al.

(10) Patent No.: US 7,436,365 B1
(45) Date of Patent: Oct. 14, 2008

(54) COMMUNICATIONS ASSEMBLY AND ANTENNA RADIATOR ASSEMBLY

(75) Inventors: Yu Chee Tan, Singapore (SG); Xi Lin (Vick) Chen, Singapore (SG); Yew Siow (Roger) Tay, Singapore (SG)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/743,180

(22) Filed: May 2, 2007

(51) Int. Cl.
*H01Q 1/24* (2006.01)

(52) U.S. Cl. ..... 343/702

(58) Field of Classification Search ..... 343/702, 343/700 MS, 846, 848, 850–853
See application file for complete search history.

(56) References Cited

U.S. PATENT DOCUMENTS

| | | | | |
|---|---|---|---|---|
| 6,011,524 | A * | 1/2000 | Jervis | 343/895 |
| 6,856,285 | B2 * | 2/2005 | Bettin et al. | 343/700 MS |
| 6,856,290 | B1 * | 2/2005 | Ryken et al. | 343/700 MS |
| 6,876,329 | B2 * | 4/2005 | Milosavljevic | 343/700 MS |
| 6,943,640 | B2 | 9/2005 | Arlow | |
| 6,943,737 | B2 * | 9/2005 | Ryken et al. | 343/700 MS |
| 6,943,738 | B1 | 9/2005 | Mattsson et al. | |
| 7,009,564 | B2 * | 3/2006 | Ryken et al. | 343/700 MS |
| 7,369,094 | B2 * | 5/2008 | Song et al. | 343/816 |
| 2003/0160728 | A1 * | 8/2003 | Fukushima et al. | 343/702 |
| 2004/0227678 | A1 * | 11/2004 | Sievenpiper | 343/702 |
| 2007/0069956 | A1 * | 3/2007 | Ozkar | 343/700 MS |

* cited by examiner

*Primary Examiner*—Huedung Mancuso
(74) *Attorney, Agent, or Firm*—Randall S. Vaas

(57) ABSTRACT

A radio communications assembly (200) and an antenna radiator assembly (201). The antenna radiator assembly (201) forms part of the radio communications assembly (200) and is housed in a housing (202, 203). The antenna radiator assembly (201) has a circuit board (210) supporting electrical conductors (225) one of which is coupled to a feed point (130). There is also a ground plane (140) and an antenna radiator element (107) is coupled to the feed point (130). The antenna radiator element (107) is spaced from the ground plane (140) and a tertiary antenna radiator arm (155) spaced from the antenna radiator element (107). There is also a first band stop filter (150) disposed in a space (212) between the tertiary antenna radiator arm (155) and the antenna radiator element (107). The first band stop filter (150) provides electrical coupling of the antenna radiator element (1070 to the tertiary antenna radiator arm (155) at its band pass frequencies. Further, the first band stop filter (150) provides for electrically de-coupling of the antenna radiator element (107) from the tertiary antenna radiator arm (155) at its first band stop bandwidth.

22 Claims, 6 Drawing Sheets

COMMUNICATIONS ASSEMBLY AND ANTENNA RADIATOR ASSEMBLY

FIELD OF THE INVENTION

This invention relates to an antenna radiator assembly and radio communications assembly including an antenna assembly. The invention is particularly useful for, but not necessarily limited to, multi-band wireless communication devices with internal antennas.

BACKGROUND ART OF THE INVENTION

Wireless communication devices often require multi-band antennas for transmitting and receiving radio communication signals often called Radio Frequency (RF) signals. When such wireless communication devices are roaming they may need to selectively register and communicated on multi-band frequencies. For example, in specific locations, some network operators may provide one or more systems for communicating with these wireless communications devices, some of these systems are typically: a) a GSM system operating in a 880 to 960 MHz frequency band; b) a UMTS system operating in a 2,110 to 2,170 MHz frequency band; and c) a DCS system operating in a 1710 to 1800 MHz frequency band. Also, wireless communication devices may require to use Bluetooth™ frequencies operating in a 2,400 to 2,484 MHz frequency band. It will also be understood that further frequency bands, such as GPS frequency bands, may be required to be used by wireless communication devices.

Current consumer requirements are for compact wireless communication devices, such as cellular or radio telephones, that typically have an internal antenna radiator element instead of an antenna stub that is visible to the user. Furthermore, there has also been a recent trend towards thin form factor cellular telephones. These thin form factor cellular telephones require a miniaturized internal antenna radiator assembly comprising an internal antenna radiator element coupled to a ground plane, the ground planes being typically formed on or in a circuit board of the telephone. Further, these internal antenna radiator elements such as a Planar Inverted F Antenna (PIFA) or Planar Inverted L Antenna (PILA) are considered advantageous in several ways because of their compact lightweight structure, which is relatively easy to fabricate and produce.

Internal antenna radiator assemblies are typically installed inside a cellular telephone where congested conductive and "lossy" components are placed nearby. The internal antenna radiator assemblies must therefore preferably be able to cover multiple frequency bands to, for instance, accommodate two or more of the 880 to 960 MHz, 2,110 to 2,170 MHz, 1710 to 1800 MHz, 2,400 to 2,484 MHz frequency bands whilst not being the deciding factor that limits the desired thin form factor of the cellular or radio telephone.

BRIEF DESCRIPTION OF THE DRAWINGS

In order that the invention may be readily understood and put into practical effect, reference now will be made to exemplary embodiments as illustrated with reference to the accompanying figures, wherein like reference numbers refer to identical or functionally similar elements throughout the separate views. The figures together with a detailed description below, are incorporated in and form part of the specification, and serve to further illustrate the embodiments and explain various principles and advantages, in accordance with the present invention, where.

Figure 1:
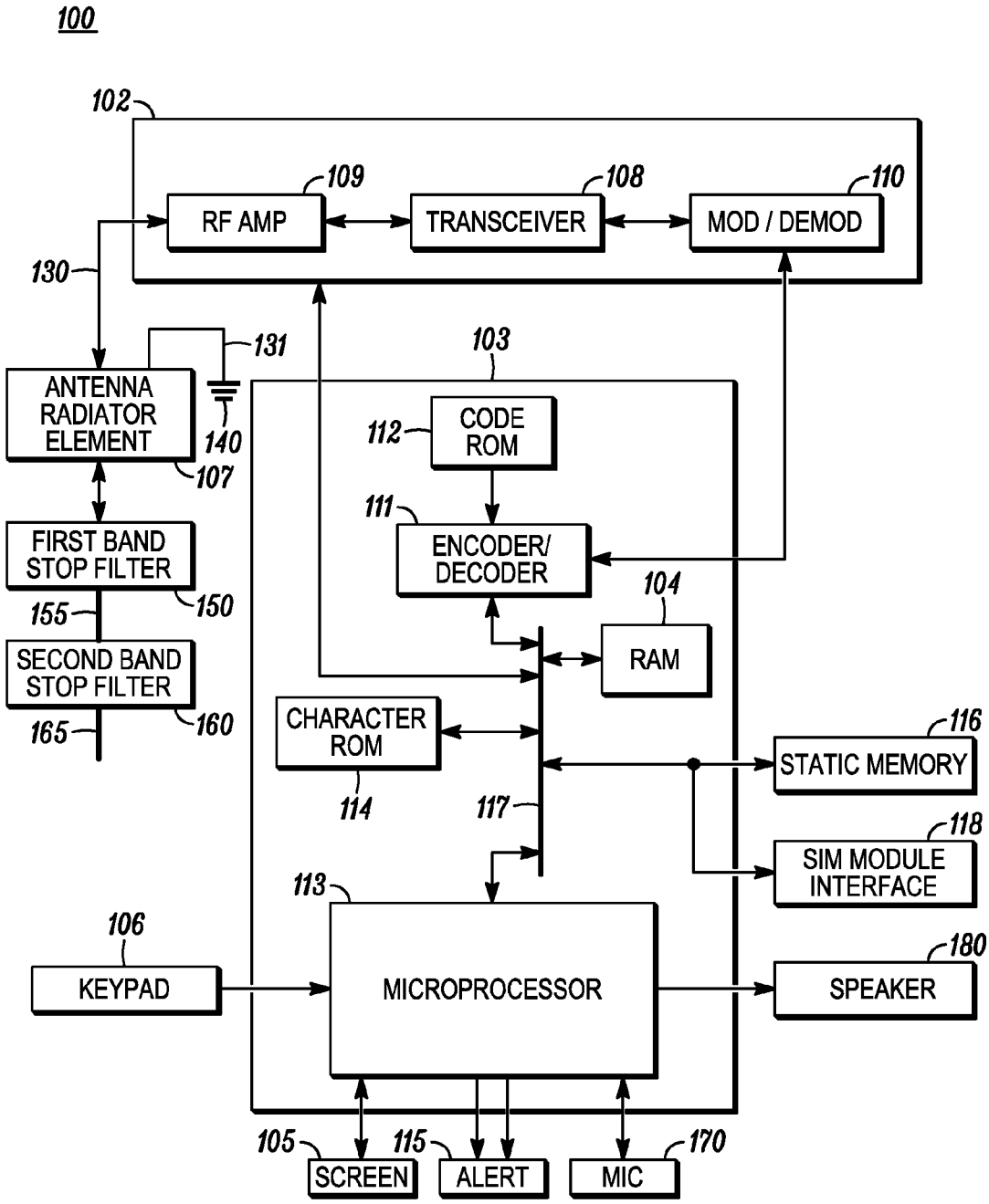
FIG. 1 is a schematic block diagram of one embodiment of a radio communications device in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations apparatus components related to radio communications assemblies and antenna radiator assemblies. Accordingly, the assembly components have been represented where appropriate by conventional symbols in the drawings, showing only those specific details that are pertinent to understanding the embodiments of the present invention, so as not to obscure the disclosure with details that will be readily apparent to those of ordinary skill in the art having the benefit of the description herein.

In this document, relational terms such as left and right, first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a radio communications assembly and antenna radiator assembly that comprises a list of elements does not include only those elements but may include other elements not expressly listed or inherent to such radio communications assemblies and antenna radiator assemblies. An element preceded by "comprises a . . . " does not, without more constraints, preclude the existence of additional identical elements in the radio communications assembly and antenna radiator assembly.

According to one aspect of the present invention there is provided an antenna radiator assembly comprising: a circuit board supporting electrical conductors, at least one of the electrical conductors being coupled to a feed point; a ground plane; at least one antenna radiator element coupled to the feed point, the antenna radiator element being spaced from the ground plane; a tertiary antenna radiator arm spaced from the antenna radiator element; and a first band stop filter disposed in a space between the tertiary antenna radiator arm and the antenna radiator element, wherein the first band stop filter provides electrical coupling of the antenna radiator element to the tertiary antenna radiator arm at band pass frequencies thereof, and wherein the first band stop filter provides for electrically de-coupling of the antenna radiator element from the tertiary antenna radiator arm at a first band stop bandwidth thereof.

According to another aspect of the present invention there is provided a radio communications assembly comprising: a housing within which is housed a circuit board supporting electrical conductors, at least one of the electrical conductors being coupled to a feed point; a ground plane, housed in the housing; at least one antenna radiator element coupled to the feed point, the antenna radiator element being spaced from the ground plane; a tertiary antenna radiator arm spaced from the antenna radiator element; and a first band stop filter disposed in a space between the tertiary antenna radiator arm and the antenna radiator element, wherein the first band stop filter provides electrical coupling of the antenna radiator element to the tertiary antenna radiator arm at band pass frequencies thereof, and wherein the first band stop filter provides for electrically de-coupling of the antenna radiator element from the tertiary antenna radiator arm at a first band stop bandwidth thereof.

With reference to FIG. 1, there is illustrated a radio communications device in the form of a radio telephone 100 comprising radio frequency communications circuitry 102 coupled to be in communication with a processor 103. An input interface in the form of a screen 105 and a keypad 106 are also coupled to be in communication with the processor 103. As will be apparent to a person skilled in the art the screen 105 can be a touch screen thereby eliminating the need for the keypad 106.

The processor 103 includes an encoder/decoder 111 with an associated Code Read Only Memory (ROM) 112 storing data for encoding and decoding voice or other signals that may be transmitted or received by the radio telephone 100. The processor 103 also includes a micro-processor 113 coupled, by a common control, data and address bus 117, to the radio frequency communications circuitry 102, encoder/decoder 111, a character Read Only Memory (ROM) 114, a Random Access Memory (RAM) 104, static programmable memory 116 and a Subscriber Identity Module (SIM) interface 118 for operatively coupling with a removable SIM card. The static programmable memory 116 and a SIM card when operatively coupled to the SIM interface 118 each can store, amongst other things, selected incoming text messages and a telephone book database.

The micro-processor 113 has ports for coupling to the keypad 106, the screen 105, a speaker 180, a microphone 170 and an alert module 115 that typically contains a speaker, vibrator motor and associated drivers. The character Read only memory 114 stores code for decoding or encoding text messages that may be received by the radio frequency communication circuitry 102, input at the keypad 106. In this embodiment the character Read Only Memory 114 also stores operating code (OC) for micro-processor 113. As will be apparent to a person skilled in the art the radio telephone 100 also has and other components that are not illustrated.

The radio frequency communications circuitry 102 is has a transceiver 108 coupled to both a radio frequency amplifier 109 and a combined modulator/demodulator 110. There is also illustrated an antenna radiator element 107 that is directly coupled to the radio frequency amplifier 109 by a feed point 130. Thus, the feed point 130 provides for electrically inductively coupling an antenna radiator element 107 to the radio frequency communications circuitry 102. A ground connector 131 provides for inductively coupling the antenna radiator element 107 to a ground plane 140.

There is also a tertiary antenna radiator arm 155 and a second antenna radiator arm 165. A first band stop filter 150 provides electrical coupling of the antenna radiator element 107 to the tertiary antenna radiator arm at band pass frequencies of the first band stop filter 150. Also, second band stop filter 160 provides electrical coupling of the second antenna radiator arm 165 to the tertiary antenna radiator arm 155 at band pass frequencies of the second band stop filter 160.

Figure 2:
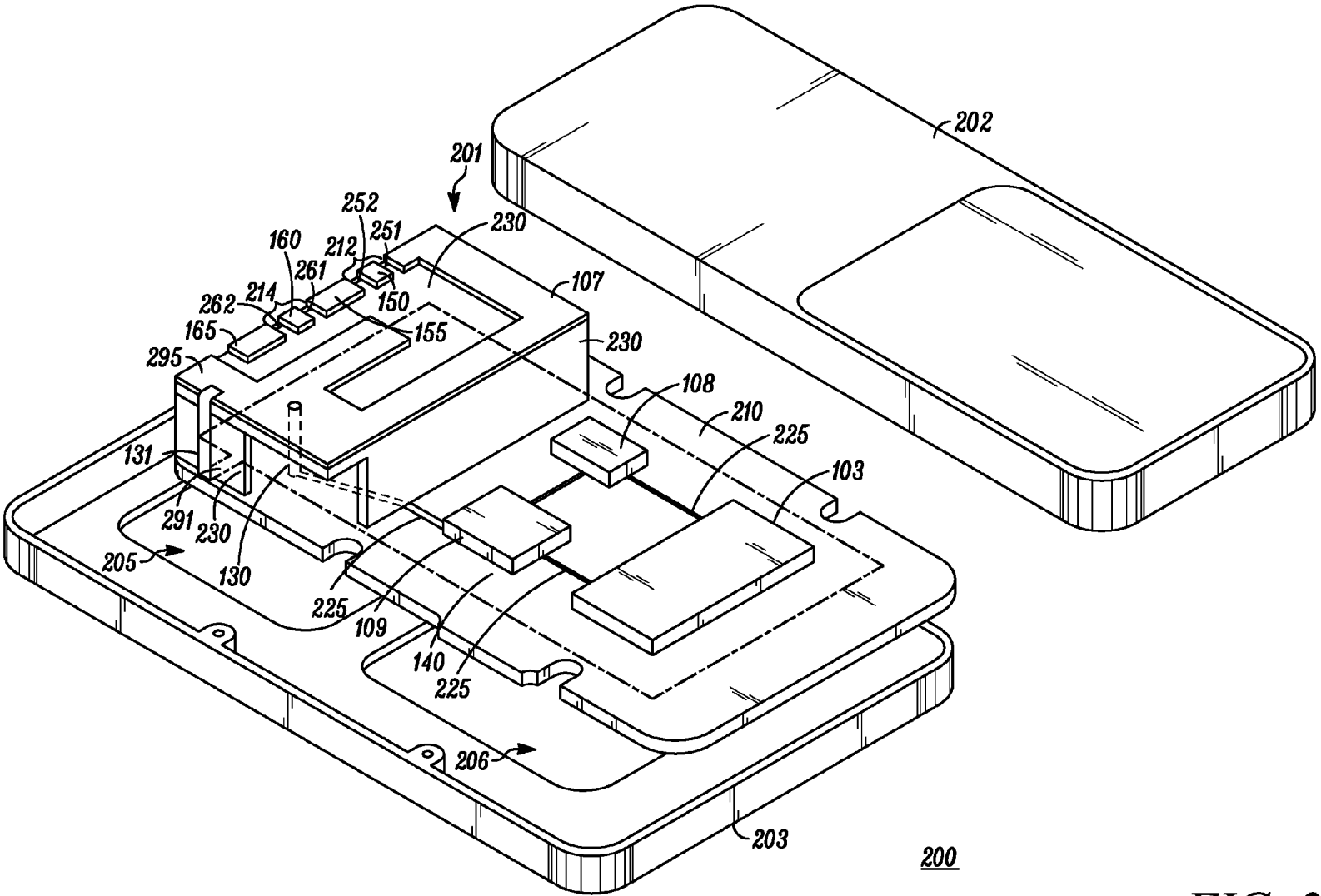
FIG. 2 is a partially exploded perspective view of a first embodiment of a radio communications assembly including an antenna radiator assembly in accordance with the invention.

Referring to FIG. 2 there is illustrated a partially exploded perspective view of a first embodiment of a radio communications assembly 200 including an antenna radiator assembly 201 forming part of the radio telephone 100. The radio communications assembly 200 comprises a circuit board 210 supporting electrical conductors or runners 225 that are typically sandwiched inside the layers of the circuit board 210 as well as being on a top and underside surfaces of the circuit board 210. The circuit board 210 provides a base for supporting the radio frequency amplifier 109, the transceiver 108, the processor 103 plus other components, units and modules of the radio telephone 100. There is a conductive plate or sheet supported by (mounted to or sandwiched inside) the circuit board 210, this conductive plate forms the ground plane 140.

The antenna radiator element 107 is mounted to a dielectric mount 230 (typically formed from a thermoplastics material) that spaces the antenna radiator element 107 from the ground plane 140. As illustrated, the antenna radiator element 107 in this embodiment is a patch antenna and comprises a flat sheet. The antenna radiator element 107 is coupled to the transceiver 108 unit through: a) the feed point 130, that is coupled to and directly contacts the antenna radiator element 107 through an aperture in the dielectric mount 230; b) the radio frequency amplifier 109; and c) some of the electrical conductors or runners 225 coupled to the feed point 130 (most runners on circuit board 210 are not shown). Also, the ground connector 131 is inductively coupled to the ground plane 140 by a runner 291 and the ground connector 131 is coupled to (contacts) the antenna radiator element 107 at a planar surface 295 of the antenna radiator element 107.

The radio communications assembly 200 also includes a housing formed from an upper housing 202 and a lower housing 203 within which is housed the circuit board 210, the antenna radiator element 107, the ground plane 140 plus other components, units and modules mentioned above forming the antenna radiator assembly 201 and radio communications assembly 200. As illustrated, the lower housing 203 has a keypad locating aperture 206 for locating a keypad membrane (not shown) associated with the keypad 106 and a lens locating aperture 205 for locating a lens (not shown) associated with the screen 105.

The tertiary antenna radiator arm 155 is spaced from the antenna radiator element 107 by a first space 212 and the first band stop filter 150 is disposed in the first space 212 that is between the tertiary antenna radiator arm 155 and the antenna radiator element 107. Also, the second antenna radiator arm 165 is spaced from the tertiary antenna radiator arm 155 by a second space 214 and the second band stop filter 160 is disposed in the second space 214 that is between the tertiary antenna radiator arm 155 and the second antenna radiator arm 165. Respective nodes of the first band stop filter 150 are connected to the tertiary antenna radiator arm 155 and the antenna radiator element 107 by wires or runners 251, 252. Also, respective nodes of the second band stop filter 160 are connected to the tertiary antenna radiator arm 155 and the second antenna radiator arm 165 by wires or runners 261, 262.

As illustrated, the antenna radiator element 107 and the tertiary antenna radiator arm 155 and second antenna radiator arm 165 are co-planar. Also, the antenna radiator element 107, the tertiary antenna radiator arm 155, the second antenna radiator arm 165, the first band stop filter 150 and the second band stop filter 160 are mounted on a common substrate provided by the dielectric mount 230.

Figure 3:
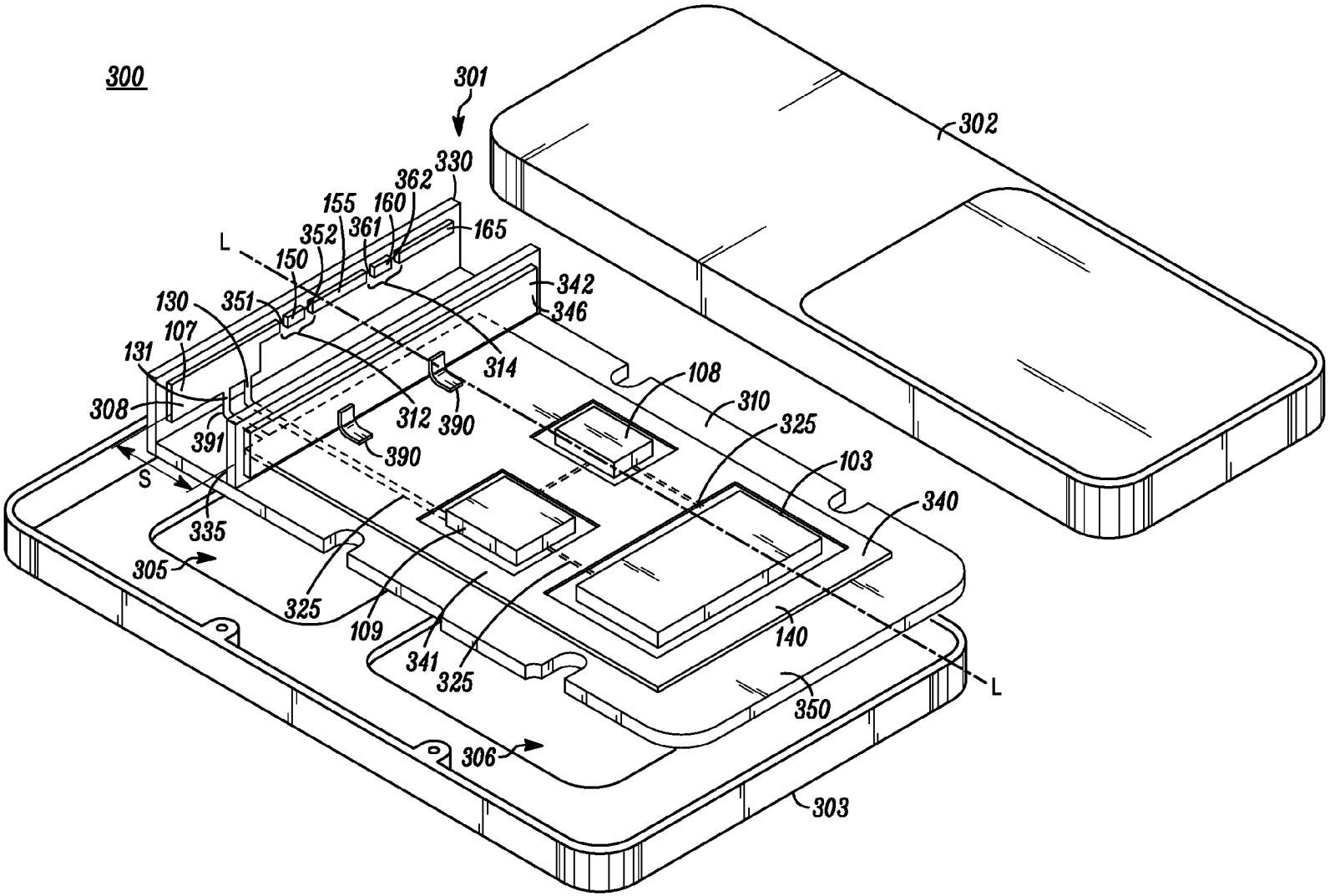
FIG. 3 is a partially exploded perspective view of a second embodiment of a radio communications assembly including an antenna radiator assembly in accordance with the invention.

Referring to FIG. 3 there is illustrated a partially exploded perspective view of a second embodiment of a radio communications assembly 300 including an antenna radiator assembly 301 forming part of the radio telephone 100. The radio communications assembly 300 comprises a circuit board 310 supporting electrical conductors or runners 325 that are typically sandwiched inside the layers of the circuit board 310. The circuit board 310 provides a base for supporting the radio frequency amplifier 109, the transceiver 108, the processor 103 plus other components, units and modules of the radio telephone 100. There is a conductive plate or sheet mounted on the circuit board 310, this conductive plate forms the ground plane 140 that includes a first planar element 341 and a second planar element 342

The antenna radiator element 107 is mounted to a dielectric mount 330 (typically formed from a thermoplastics material) that spaces the antenna radiator element 107 from the ground plane 140 along a longitudinal axis L as illustrated by arrowed line S. As illustrated, the antenna radiator element 107 in this embodiment is a Planar Inverted F Antenna (PIFA) and comprises a flat sheet. The antenna radiator element 107 is coupled to the transceiver 108 unit through: a) the feed point 130 that is integrally formed with the antenna radiator element 107 and therefore is coupled to and directly contacts the antenna radiator element 107; b) the radio frequency amplifier 109; and c) some of the electrical conductors or runners 325 coupled to the feed point 130 (most runners on circuit board 310 are not shown). Also, the ground connector 131 is coupled to the ground plane 140 by a runner 391 and the ground connector 131 is integrally formed with the antenna radiator element 107 and therefore is coupled to (contacts) the antenna radiator element 107.

The radio communications assembly 300 also includes a housing formed from an upper housing 302 and a lower housing 303 within which is housed the circuit board 310, the antenna radiator element 107, the ground plane 140 plus other components, units and modules mentioned above forming the antenna radiator assembly 301 and radio communications assembly 300. As illustrated, the lower housing 303 has a keypad locating aperture 306 for locating a keypad membrane (not shown) associated with the keypad 106 and a lens locating aperture 305 for locating a lens (not shown) associated with the screen 105.

The tertiary antenna radiator arm 155 is spaced from the antenna radiator element 107 by a first space 312 and the first band stop filter 150 is disposed in the first space 312 that is between the tertiary antenna radiator arm 155 and the antenna radiator element 107. Also, the second antenna radiator arm 165 is spaced from the tertiary antenna radiator arm 155 by a second space 314 and the second band stop filter 160 is disposed in the second space 314 that is between the tertiary antenna radiator arm 155 and the second antenna radiator arm 165. Respective nodes of the first band stop filter 150 are connected to the tertiary antenna radiator arm 155 and the antenna radiator element 107 by wires or runners 351, 352. Also, respective nodes of the second band stop filter 160 are connected to the tertiary antenna radiator arm 155 and the second antenna radiator arm 165 by wires or runners 361, 362.

As illustrated, the antenna radiator element 107 and the tertiary antenna radiator arm 155 and second antenna radiator arm 165 are co-planar. Also, the antenna radiator element 107, the tertiary antenna radiator arm 155, the second antenna radiator arm 165, the first band stop filter 150 and the second band stop filter 160 are mounted on a common substrate provided by the dielectric mount 330.

The first planar element 341 has a surface with a first planar element plane 340 that is parallel to a surface 350 of the circuit board 310. The radio communications assembly 300 also includes the second planar element 342 that forms part of the ground plane 140, the second planar element 342, mounted on a support 335, has a surface 346 with a second planar element plane 345 that is lateral to the first planar element plane 340. As shown, the second planar element 342 is electrically coupled to the first planar element 341 by conductive resilient legs 390. Furthermore, a surface area of the antenna radiator element 107 has an antenna radiator element plane 308 that lateral to the first planar element plane 340. There are also other typical components/modules (not shown for clarity) and other conductive plates may be provided and combined forming the ground plane 140 that are mounted to or electrically coupled the circuit board 310.

Figure 4:
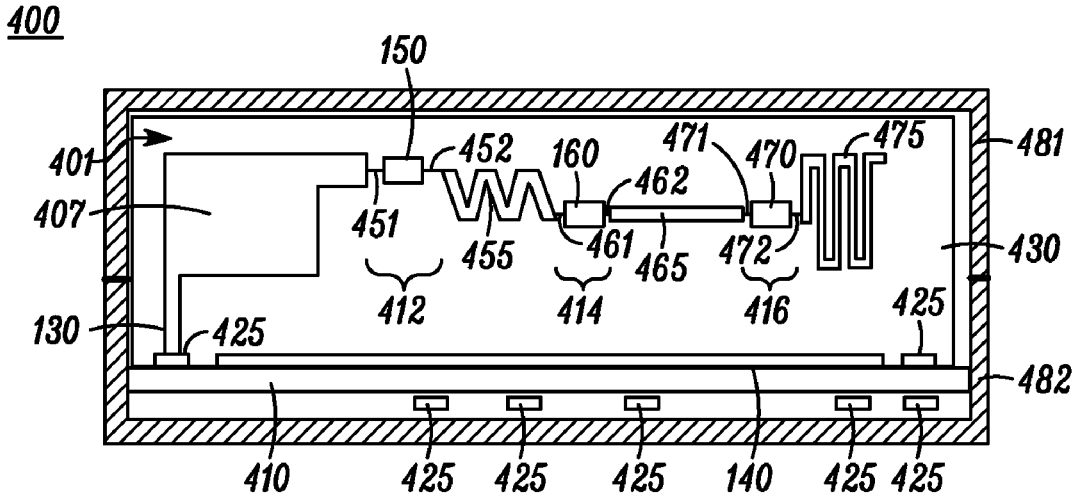
FIG. 4 is a cross sectional view of a third embodiment of a radio communications assembly including an antenna radiator assembly in accordance with the invention.

Referring to FIG. 4 there is illustrated a cross sectional view of a third embodiment of a radio communications assembly 400 including an antenna radiator assembly 410 that can form part of the radio telephone 100 with slightly modified components and added components. The radio communications assembly 400 comprises a circuit board 410 supporting electrical conductors 425, at least one of the electrical conductors 425 being coupled to the feed point 130. The ground plane 140 is formed from a conductive sheet supported by the circuit board 410.

The antenna radiator element 107 is in the form of a Planar Inverted L Antenna (PILA) 407 that is mounted to a dielectric mount 430 and the Planar Inverted L Antenna (PILA) 407 is inductively coupled to the feed point 130. The Planar Inverted L Antenna (PILA) 407 is spaced from the ground plane 140 and the tertiary antenna radiator arm in the form of a meander 455 is spaced from the Planar Inverted L Antenna (PILA) 407. The first band stop filter 150 is disposed in a space 412 between the meander 455 and the Planar Inverted L Antenna (PILA) 407. The second antenna radiator arm is a straight conductor 465 that is spaced from the meander 455 and the second band stop filter 160 is disposed in a space 414 between the meander 455 and the straight conductor 465. In this embodiment there is a third antenna radiator arm in the form of a further meander 475 that is spaced from the straight conductor 465 and a third band stop filter 470 is disposed in a space 416 between the further meander 475 and the straight conductor 465. Respective nodes of the first band stop filter 150 are connected to the meander 455 and the Planar Inverted L Antenna (PILA) 407 by wires or runners 451, 452. Also, respective nodes of the second band stop filter 160 are connected to the meander 455 and the straight conductor 465 by wires or runners 461, 462. In addition, respective nodes of the third band stop filter 470 are connected to the further meander 475 and the straight conductor 465 by wires or runners 471, 472.

The Planar Inverted L Antenna (PILA) 407, meander 455, straight conductor 465 and further meander 475 are co-planar. Also, the Planar Inverted L Antenna (PILA) 407, meander 455, straight conductor 465 and further meander 475, the first band stop filter 150 the second band stop filter 160 and third band stop filter 470 are mounted on a common substrate provided by the dielectric mount 430.

The radio communications assembly 400 also includes a housing formed from an upper housing 481 and a lower housing 482 within which is housed the circuit board 410, the antenna radiator element 407, the ground plane 140 plus other components, units and modules mentioned above forming the antenna radiator assembly 401 and radio communications assembly 400.

Figure 5:
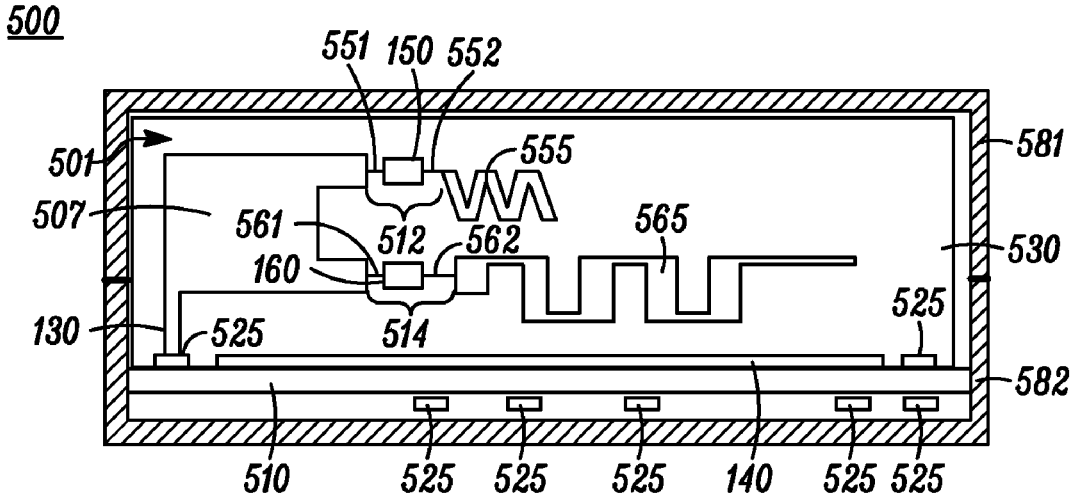
FIG. 5 is a cross sectional view of a fourth embodiment of a radio communications assembly including an antenna radiator assembly in accordance with the invention.

Referring to FIG. 5 there is illustrated a cross sectional view of a fourth embodiment of a radio communications assembly 500 including an antenna radiator assembly 501 410 that can form part of the radio telephone 100 with slightly modified components. The radio communications assembly 500 comprises a circuit board 510 supporting electrical conductors 525, at least one of the electrical conductors 525 being coupled to the feed point 130. The ground plane 140 is formed from a conductive sheet supported by the circuit board 510.

The antenna radiator element 107 is in the form of a Planar Inverted L Antenna (PILA) 507 that is mounted to a dielectric mount 530 and the Planar Inverted L Antenna (PILA) 507 is inductively coupled to the feed point 130. The Planar Inverted L Antenna (PILA) 507 is spaced from the ground plane 140 and the tertiary antenna radiator arm in the form of a meander 555 is spaced from the Planar Inverted L Antenna (PILA) 507. The first band stop filter 150 is disposed in a space 512 between the meander 555 and the Planar Inverted L Antenna (PILA) 507. The second antenna radiator arm is also a meander 565 that is spaced from the Planar Inverted L Antenna (PILA) 507 and the second band stop filter 160 is disposed in a space 514 between the meander 565 and the Planar Inverted L Antenna (PILA) 507. Respective nodes of the first band stop filter 150 are connected to the meander 555 and the Planar Inverted L Antenna (PILA) 507 by wires or runners 551, 552. Also, respective nodes of the second band stop filter 160 are connected to the meander 565 and the Planar Inverted L Antenna (PILA) 507 by wires or runners 561, 562.

The Planar Inverted L Antenna (PILA) 507, meander 555 and meander 565 are co-planar. Also, the Planar Inverted L Antenna (PILA) 507, meander 555, meander 565, the first band stop filter 150 and the second band stop filter 160 are mounted on a common substrate provided by the dielectric mount 530.

The radio communications assembly 500 also includes a housing formed from an upper housing 581 and a lower housing 582 within which is housed the circuit board 510, the antenna radiator element 507, the ground plane 140 plus other components, units and modules mentioned above forming the antenna radiator assembly 501 and radio communications assembly 500.

Figure 6:
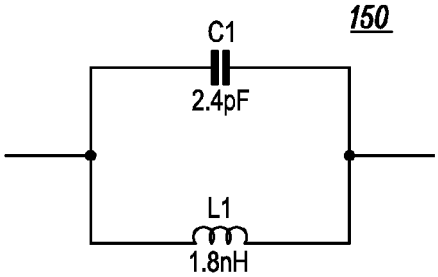
FIG. 6 is a circuit diagram illustrating one embodiment of a first band stop filter in accordance with the invention.
Figure 7:
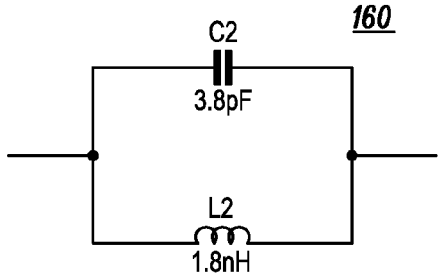
FIG. 7 is a circuit diagram illustrating one embodiment of a second band stop filter in accordance with the invention.

Referring to FIG. 6 the first band stop filter 150 is illustrated. The first band stop filter is a capacitor C1 connected in parallel with an inductor L1. In this embodiment the value of the capacitor C1 is 2.4 pF and the value of the inductor L1 is 1.8 nH, thus the resonant frequency for the first band stop filter 150 is approximately 2.45 MHz. In FIG. 7 the second band stop filter 160 is illustrated. The second band stop filter 160 is a capacitor C2 connected in parallel with an inductor L2. In this embodiment the value of the capacitor C1 is 3.8 pF and the value of the inductor 21 is 1.8 nH, thus the resonant frequency for the second band stop filter 160 is approximately 2.11 MHz. As will be appreciated to a person skilled in the art, the third band stop filter 470 is also a capacitor connected in parallel with an inductor with their values selected for the desired resonant frequency.

Figure 8:
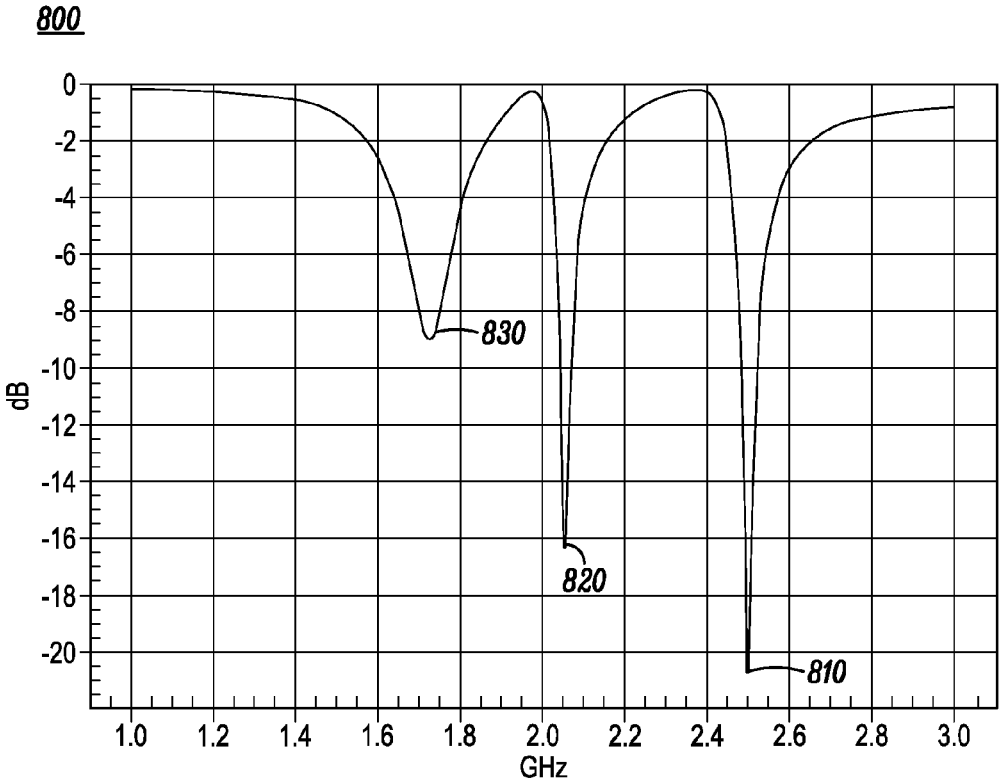
FIG. 8 is frequency response for the antenna radiator assemblies of FIGS. 2, 3 and 5.

In FIG. 8 a frequency response 800 of the antenna radiator assemblies 201, 301 or 501 are illustrated. By way of example only, the frequency response 800 will be described with reference to the antenna radiator assembly 201. In use, when the first band stop filter 150 is resonating at its resonant frequency FR1 it is essentially open circuit, therefore it electrically de-couples the tertiary antenna radiator arm 155 and the second antenna radiator arm 165 from the antenna radiator element 107. The antenna radiator assembly 201 is therefore operating such that its operating frequency is in the Bluetooth™ 2,400 to 2,484 MHz frequency band as illustrated by arrow 810 in which the effective antenna length is only provided by the antenna radiator element 107.

When the first band stop filter 150 is not resonating at its resonant frequency FR1 it is essentially a low impedance circuit, therefore it electrically couples the tertiary antenna radiator arm 155 to the antenna radiator element 107. However, if the second band stop filter 160 is resonating at its resonant frequency FR2 (where FR2 is not equal to FR1) it is essentially open circuit, therefore it electrically de-couples the second antenna radiator arm 165 from the tertiary antenna radiator arm 155. The antenna radiator assembly 201 is therefore operating such that its operating is in the UMTS 2,110 to 2,170 MHz frequency band as illustrated by arrow 820 in which the effective antenna length is provided by the antenna radiator element 107 and the tertiary antenna radiator arm 155.

When the first band stop filter 150 and second band stop filter are not resonating at their respective resonant frequencies FR1, FR2 they are essentially a low impedance circuits, therefore they electrically couple the second antenna radiator arm 165 to the tertiary antenna radiator arm 155 that in turn is coupled to the antenna radiator element 107. The antenna radiator assembly 201 is therefore operating such that its operating is in the DCS system 1710 to 1800 MHz frequency band as illustrated by arrow 830 in which the effective antenna length is provided by the antenna radiator element 107 and the tertiary antenna radiator arm 155 series coupled to the second antenna radiator arm 165. It should be noted that the shape of the antenna radiator element 107 is such that it has two effective lengths giving rise an additional frequency band option.

As will be apparent to a person skilled in the art, when considering the antenna radiator assembly 501, the first band stop filter 150 and the second band stop filter 160 selectively couple or decouple one or both of the meanders 555, 565 directly with the Planar Inverted L Antenna (PILA) 507 to thereby achieve the frequency response 800.

Figure 9:
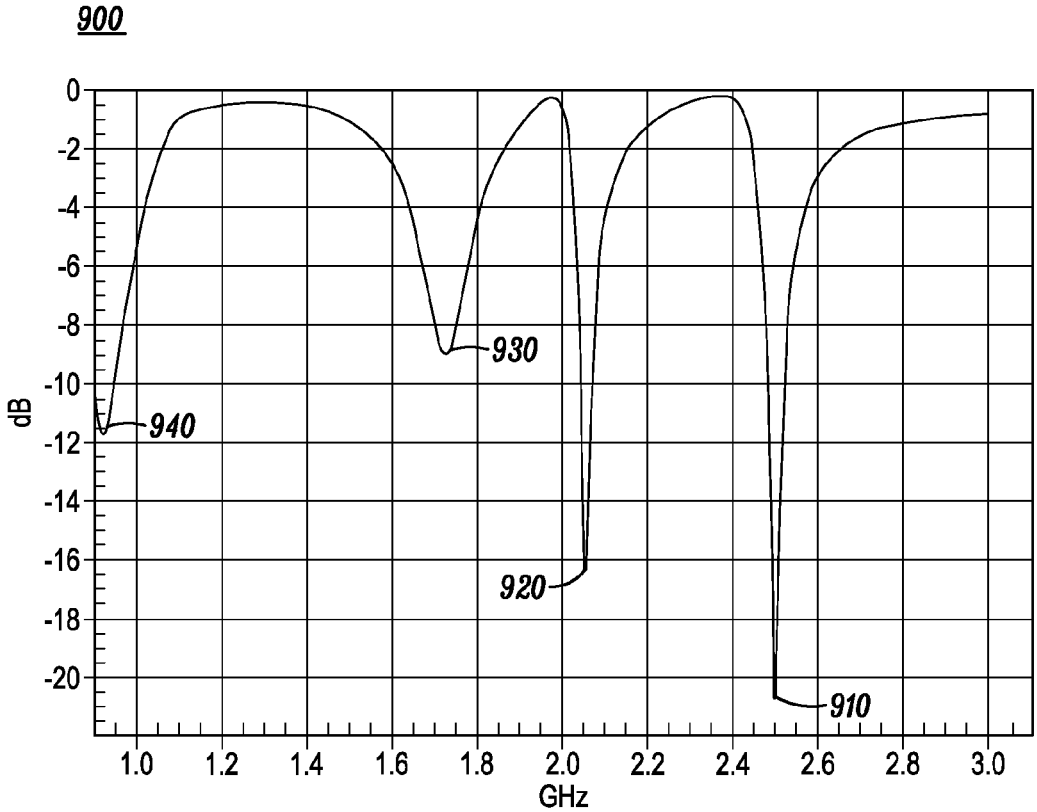
FIG. 9 is frequency response for the antenna radiator assembly of FIG. 4.

In FIG. 9 a frequency response 900 of the antenna radiator assembly 401 is illustrated. The first band stop filter 150 and second band stop filter 160 perform in the same manner as described with reference to the frequency response 800 to provide the Bluetooth™ 2,400 to 2,484 MHz frequency band as illustrated by arrow 910, the UMTS 2,110 to 2,170 MHz frequency band as illustrated by arrow 920 and the DCS system 1710 to 1800 MHz frequency band as illustrated by arrow 930. In addition, when the first, second and third band stop filters 150, 160, 470 are series coupling the further meander 475, the straight conductor 465 and meander 455 to antenna radiator element 107, the antenna radiator assembly 401 is operating in the GSM system 880 to 960 MHz frequency band as illustrated by arrow 940.

Advantageously, the present invention provides for compact, antenna radiator assembly and a radio communications assembly capable of operating at multiple frequency bands thereby accommodating two or more frequency bands such as the 880 to 960 MHz, 2,110 to 2,170 MHz, 1710 to 1800 MHz, 2,400 to 2,484 MHz frequency bands whilst not being the deciding factor that limits the desired thin form factor of the cellular or radio telephone. In this regard, the first band stop filter 150 provides electrical coupling of the antenna radiator element 107 to the tertiary antenna radiator arm 155 at band pass frequencies thereof. Also, the first band stop filter 150 provides for electrically de-coupling of the antenna radiator element 107 from the tertiary antenna radiator arm at a first band stop bandwidth thereof. In addition, when considering the antenna radiator assemblies 201, 301 or 401, the second band stop filter 160 provides electrical coupling of the second antenna radiator arm 165 to the tertiary antenna radiator arm 155 at band pass frequencies thereof. Also, the second band stop filter 160 provides for electrically de-coupling of the second antenna radiator arm from the tertiary antenna radiator arm at a second band stop bandwidth thereof. Alternatively, when considering the antenna radiator assembly 501, the second band stop filter 160 provides electrical coupling of the second antenna radiator arm or meander 565 to the antenna radiator element 507 at band pass frequencies thereof. Also, the second band stop filter 160 provides for electrically de-coupling of the second antenna radiator arm or meander 565 from the antenna radiator element 507 at a second band stop bandwidth thereof.

The detailed description provides preferred exemplary embodiments only, and is not intended to limit the scope, applicability, or configuration of the invention. Rather, the detailed description of the preferred exemplary embodiments provide those skilled in the art with an enabling description only. It should be understood that various changes may be made in the function and arrangement of elements without departing from the spirit and scope of the invention as set forth in the appended claims.

We claim:

1. An antenna radiator assembly comprising:

a circuit board supporting electrical conductors, at least one of the electrical conductors being coupled to a feed point;

a ground plane;

at least one antenna radiator element coupled to the feed point, the antenna radiator element being spaced from the ground plane;

a tertiary antenna radiator arm spaced from the antenna radiator element; and a first band stop filter disposed in a space between the tertiary antenna radiator arm and the antenna radiator element, wherein the first band stop filter provides electrical coupling of the antenna radiator element to the tertiary antenna radiator arm at band pass frequencies thereof, and wherein the first band stop filter provides for electrically de-coupling of the antenna radiator element from the tertiary antenna radiator arm at a first band stop bandwidth thereof.

2. An antenna radiator assembly, as claimed in claim 1, wherein the antenna radiator element and the tertiary antenna radiator arm are co-planar.

3. An antenna radiator assembly, as claimed in claim 1, wherein the antenna radiator element, tertiary antenna radiator arm and first band stop filter are mounted on a common substrate.

4. An antenna radiator assembly, as claimed in claim 1, further comprising:

a second antenna radiator arm spaced from the tertiary antenna radiator arm; and a second band stop filter disposed in a space between the tertiary antenna radiator arm and the second antenna radiator arm, wherein the second band stop filter provides electrical coupling of the second antenna radiator arm to the tertiary antenna radiator arm at band pass frequencies thereof, and wherein the second band stop filter provides for electrically de-coupling of the second antenna radiator arm from the tertiary antenna radiator arm at a second band stop bandwidth thereof.

5. An antenna radiator assembly, as claimed in claim 4, wherein the second antenna radiator arm and the tertiary antenna radiator arm are co-planar.

6. An antenna radiator assembly, as claimed in claim 4, wherein the antenna radiator element, tertiary antenna radiator arm, second antenna radiator arm, first band stop filter and second band stop filter are mounted on a common substrate.

7. An antenna radiator assembly, as claimed in claim 1, wherein the first band stop filter comprises a capacitor connected in parallel with an inductor.

8. An antenna radiator assembly, as claimed in claim 4, wherein the second band stop filter comprises a capacitor connected in parallel with an inductor.

9. An antenna radiator assembly, as claimed in claim 1, further comprising:

a second antenna radiator arm spaced from the antenna radiator element; and a second band stop filter in a space between the tertiary antenna radiator arm and the antenna radiator element, wherein the second band stop filter provides electrical coupling of the second antenna radiator arm to the antenna radiator element at band pass frequencies thereof, and wherein the second band stop filter provides for electrically de-coupling of the second antenna radiator arm from the antenna radiator element at a second band stop bandwidth thereof.

10. An antenna radiator assembly, as claimed in claim 1, wherein the ground plane comprises least a first planar element and a second planar element, the first planar element being supported by the circuit board and having a first planar element plane parallel to a surface of the circuit board, and the second planar element having a second planar element plane lateral to the first planar element plane.

11. An antenna radiator assembly, as claimed in claim 10, wherein a surface area of the antenna radiator element having an antenna radiator element plane is lateral to the first planar element plane.

12. An antenna radiator assembly as claimed in claim 11 wherein the antenna radiator element plane is parallel to the second planar element plane.

13. A radio communications assembly comprising:

a housing within which is housed a circuit board supporting electrical conductors, at least one of the electrical conductors being coupled to a feed point;

a ground plane, housed in the housing;

at least one antenna radiator element coupled to the feed point, the antenna radiator element being spaced from the ground plane;

a tertiary antenna radiator arm spaced from the antenna radiator element; and a first band stop filter disposed in a space between the tertiary antenna radiator arm and the antenna radiator element, wherein the first band stop filter provides electrical coupling of the antenna radiator element to the tertiary antenna radiator arm at band pass frequencies thereof, and wherein the first band stop filter provides for electrically de-coupling of the antenna radiator element from the tertiary antenna radiator arm at a first band stop bandwidth thereof.

14. An antenna radiator assembly, as claimed in claim 13, wherein the antenna radiator element and the tertiary antenna radiator arm are co-planar.

15. An antenna radiator assembly, as claimed in claim 13, wherein the antenna radiator element, tertiary antenna radiator arm and first band stop filter are mounted on a common substrate.

16. An antenna radiator assembly, as claimed in claim 13, further comprising:

a second antenna radiator arm spaced from the tertiary antenna radiator arm; and a second band stop filter disposed in a space between the tertiary antenna radiator arm and the second antenna radiator arm, wherein the second band stop filter provides electrical coupling of the second antenna radiator arm to the tertiary antenna radiator arm at band pass frequencies thereof, and wherein the second band stop filter provides for electrically de-coupling of the second antenna radiator arm from the tertiary antenna radiator arm at a second band stop bandwidth thereof.

17. An antenna radiator assembly, as claimed in claim 16, wherein the second antenna radiator arm and the tertiary antenna radiator arm are co-planar.

18. An antenna radiator assembly, as claimed in claim 16, wherein the antenna radiator element, tertiary antenna radiator arm, second antenna radiator arm, first band stop filter and second band stop filter are mounted on a common substrate.

19. An antenna radiator assembly, as claimed in claim 13, further comprising:

a second antenna radiator arm spaced from the antenna radiator element; and a second band stop filter in a space between the tertiary antenna radiator arm and the antenna radiator element, wherein the second band stop filter provides electrical coupling of the second antenna radiator arm to the antenna radiator element at band pass frequencies thereof, and wherein the second band stop filter provides for electrically de-coupling of the second antenna radiator arm from the antenna radiator element at a second band stop bandwidth thereof.

20. An antenna radiator assembly, as claimed in claim 13, wherein the ground plane comprises least a first planar element and a second planar element, the first planar element being supported by the circuit board and having a first planar element plane parallel to a surface of the circuit board, and the second planar element having a second planar element plane lateral to the first planar element plane.

21. An antenna radiator assembly, as claimed in claim 20, wherein a surface area of the antenna radiator element having an antenna radiator element plane is lateral to the first planar element plane.

22. An antenna radiator assembly as claimed in claim 21 wherein the antenna radiator element plane is parallel to the second planar element plane.

* * * * *